United States Patent [19]

Acuff

[11] 4,181,230

[45] Jan. 1, 1980

[54] STORE DISPLAY FIXTURE

[75] Inventor: David W. Acuff, Paragould, Ark.

[73] Assignee: Darling Store Fixtures, a division of the Marmon Group, Inc., Paragould, Ark.

[21] Appl. No.: 861,425

[22] Filed: Dec. 16, 1977

[51] Int. Cl.[2] ..... A47F 5/13

[52] U.S. Cl. ..... 211/208; 211/183; 248/408; 403/108; 403/329

[58] Field of Search ..... 248/408, 409; 211/182, 211/208, 192, 207, 190, 204, 193, 191, 195; 403/108, 329

[56] References Cited

U.S. PATENT DOCUMENTS

| | | | |
|---|---|---|---|
| 2,243,190 | 5/1941 | Capaldo | 248/408 X |
| 2,530,877 | 11/1950 | Heck et al. | 248/408 X |
| 2,921,763 | 1/1960 | Miller et al. | 403/108 X |
| 3,239,255 | 3/1966 | Murcott | 403/329 |
| 3,447,488 | 6/1969 | Lehrman | 211/195 X |
| 3,508,666 | 4/1970 | Schwengel | 211/208 |
| 3,533,513 | 10/1970 | Berman | 211/182 X |

FOREIGN PATENT DOCUMENTS

| | | | |
|---|---|---|---|
| 1364312 | 5/1964 | France | 403/108 |

*Primary Examiner*—Roy D. Frazier
*Assistant Examiner*—Robert W. Gibson, Jr.
*Attorney, Agent, or Firm*—Emch, Schaffer, Schaub & Todd

[57] ABSTRACT

A store display fixture for hanging garments and the like is disclosed having at least one hangrod affixed to at least one downwardly extending rectangular or round or square tube in telescopic engagement with another rectangular tube. The inner tube includes a compression spring-biased plunger projecting therefrom and through one of a column of openings vertically spaced apart along the outer tube. The end of the plunger is beveled to form both an upward and a downward inclined surface such that the tubes are locked into place against collapse during use but may be extended by merely pulling the downwardly extending tube upward. The tubes are retractable by manually depressing the plunger and allowing the downwardly extending tube to slide into a lower position.

11 Claims, 4 Drawing Figures

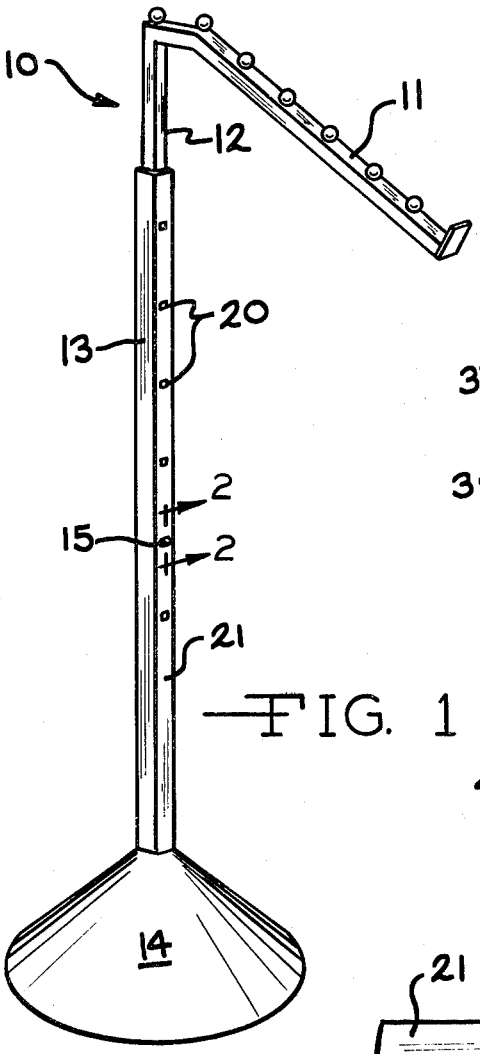
FIG. 1
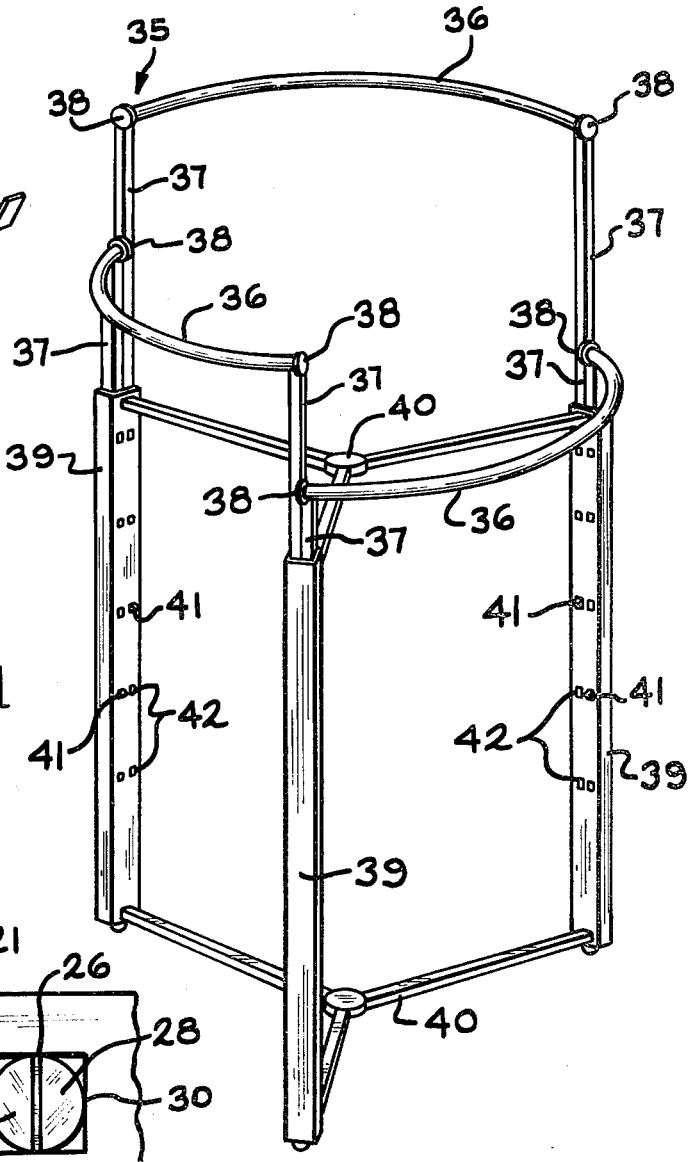
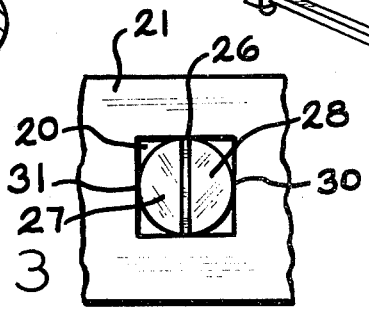
FIG. 3
FIG. 4
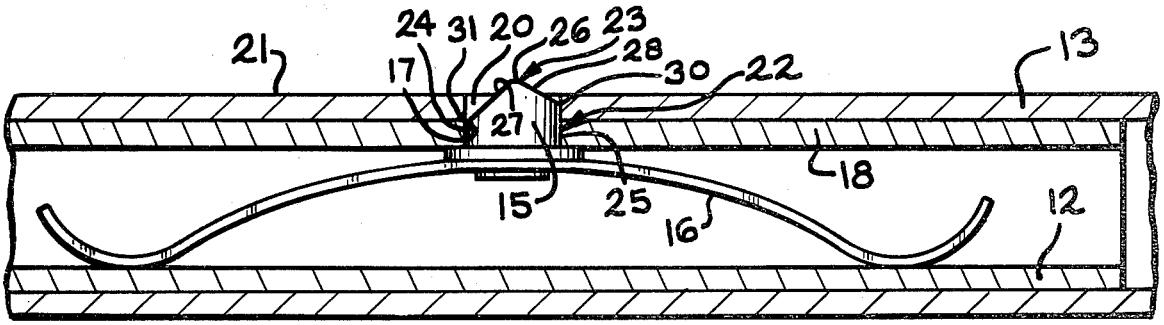
FIG. 2

STORE DISPLAY FIXTURE

BACKGROUND OF THE INVENTION

The present invention relates to store display fixtures for hanging such items as garments, curtains, towels and the like. More specifically, it relates to hangrods mounted on a framework having legs which are telescopically adjustable for height.

In the prior art, similar display fixtures are known which have legs comprised of two telescoping tubes, the inner tube including a compression spring-loaded plunger projecting from one side, and the outer tube including a column of vertically spaced-apart openings along one side for receiving the plunger, thereby locking it and the tubes in place. The legs are lengthened or retracted by manually depressing the plunger back through the opening which it occupies and then exerting an upward or downward force until the plunger is received in the adjacent opening. That process is repeated until the plunger becomes seated in the opening which establishes the desired leg height.

In the case of such a display fixture having only one leg, it is difficult for a single person to simultaneously depress the plunger and lift the upper tube, especially if the hangrod is loaded. The task is impossible with fixtures having two or more legs, such fixtures requiring at least one person per leg. Retracting the legs requires less force due to the aid of gravity, but in the case of fixtures with two or more legs, additional persons are still needed to simultaneously depress all plungers. The prior art fixtures are additionally cumbersome because of their inability to adjust by more than one opening in the outer tube at a time.

SUMMARY OF THE INVENTION

The present invention discloses a store display fixture for hanging garments and the like, having hangrods affixed to telescoping legs which include means enabling a single person to extend the length thereof and to do so by a single step. In one preferred embodiment, the legs comprise an inner rectangular tube having a compression spring-loaded plunger projecting from one side, and an outer rectangular tube having a column of vertically aligned and spaced-apart openings along one side for receiving the plunger and retaining it and the tubes in position.

The plunger includes an outer cylindrical surface and a projecting end which has been beveled to form a peak edge between upward and downward divergently sloping surfaces. The lowermost plane of or tangent to the cylindrical surface intersects the downward sloping surface within or outward from the openings in the outer tube, thereby resulting in contact between the cylindrical surface and the outer tube and preventing retraction of the legs without first manually depressing the plunger. The uppermost plane of or tangent to the cylindrical surface intersects the upward sloping surface inward from the openings, thereby allowing automatic depression of the plunger through contact between the upward surface and the outer tube and extension of the legs by merely exerting an upward force against the hangrods at a central position with the fixture framework. Means are also provided allowing a single person to retract the legs.

It is, therefore, an object of this invention to provide a store display fixture for hanging garments and the like, having hangrods affixed to telescoping legs which can be extended by a single person.

It is further an object to provide such a fixture whereby the extension may be accomplished in a single step. Other objects and advantages will be apparent to those skilled in the art from the following detailed description of the preferred embodiments of the invention.

BRIEF DESCRIPTION OF THE DRAWINGS

FIG. 1 is an overall perspective view of one embodiment of the present invention having only one hangrod and one telescoping leg;

FIG. 2 is an overall perspective view of another embodiment of the present invention having three hangrods and three telescoping legs;

FIG. 3 is a sectional view along the line 3-3 in FIG. 1; and

FIG. 4 is a top plan of FIG. 3.

DETAILED DESCRIPTION OF THE DRAWINGS

FIG. 1 is an overall perspective view of a store display fixture 10 having a single hangrod 11 affixed to a downwardly extending, inner rectangular tube 12 in telescoping engagement with an outer rectangular tube 13 and mounted on a stand 14.

A cylindrical plunger 15 affixed to a spring 16 is mounted within the inner tube 12 such that the plunger 15 projects through a circular hole 17 in one side 18 of the inner tube 12, as shown in FIG. 2. The outer tube 13 includes vertically aligned and spaced apart square openings 20 along the side 21 for receiving the plunger 15. The plunger 15 includes an outer cylindrical surface 22 and a projecting end 23. The outer cylindrical surface 22 has uppermost and lowermost tangents 24 and 25, respectively. The projecting end 23 includes a truncated peak 26 between divergently sloping upward and downward surfaces 27 and 28, respectively. The lowermost tangent 25 intersects the downward surface 28 at a point 30 within the opening 20. The uppermost tangent 24 intersects the upward surface 27 at a point 31 inward from the opening 20.

The height of the hangrod 11 may be raised by merely lifting up on the inner tube 12, causing the side 21 of the outer tube 13 to encounter the upward surface 27, thereby depressing the plunger 15 until it seats in the desired opening 20. The plunger 15 may be raised to any upper opening 20 in a single step. The inner tube 12 may be retracted by manually depressing the plunger 15 and exerting a downward force against the inner tube 12. Oftentimes, gravity alone is a sufficient downward force, especially if the hangrod is loaded with garments.

The tubes 12, 13 are shown as being rectangular to aid in aligning and maintaining the alignment to the spring and plunger assembly with the hole 17. However, other shapes, such as round, oblong, etc., are operable. The outer surface 22 of the plunger 15 is preferably cylindrical since such a geometry allows the upward and downward sloping surfaces 27, 28 to be arcuate, which results in less contact between those surfaces 27, 28 and the outer tube 13 at a time when friction is least desired, i.e., to overcome the initial inertia when the tubes 12, 13 are being extended or retracted. The peak 26 is preferably truncated so that it may be manually depressed without causing injury to the finger. Although the slope of the upward and downward surfaces, 27 and 28, may vary somewhat, it has been found that a 45° slope from the axis of the plunger 15 for the upward surface, and a 65° slope for the downward surface provides particularly good results.

FIG. 4 shows another store display fixture 35 in accordance with the present invention including three arcuate hangrods 36 having downwardly extending, inner rectangular tubes 37 at each end 38 in telescopic engagement with three outer rectangular tubes 39. The fixture 35 is further supported by crossbars 40 extending between and affixed to the outer tubes 39.

Each of the inner tubes 37 includes a plunger 41 and spring (not shown) as described above. The outer tubes 39 are wide enough to include two columns of vertically aligned and spaced apart openings 42 for receiving and engaging two inner tubes 37, each from different hangrods 36, as illustrated in FIG. 3. Each hangrod 36 is, therefore, individually adjustable in the same manner as described above with respect to FIG. 1.

Although the above preferred embodiments have been described such that the inner tube extends downwardly from the hangrod and slidably engages the lower supporting outer tube, it should be obvious that, in embodiments having one inner tube per each outer tube, the outer tube could downwardly extend from the hangrod and the inner tube could provide the base support. With such an embodiment, of course, the lowermost tangent to the plunger's cylindrical surface must intersect the downward sloping surface at a point inward from the openings in the outer tube, and the uppermost tangent must intersect the upward sloping surface at a point within or outward from the openings.

Various other modifications may also be made to the above described preferred embodiments without departing from the scope of the attached claims.

What I claim is:

1. A store display fixture for hanging garments and the like having at least one hangrod affixed to at least one downwardly extending first tube in telescopic engagement with a second tube, means associated with said second tube for maintaining said tubes in substantially vertical orientation, the inner tube including a hole through one side and a compression spring and plunger, said plunger being fixed to said spring and said plunger and spring being mounted within said inner tube such that said plunger is aligned with said hole and projects therethrough, said plunger including an outer surface parallel to its major axis and a projecting end, said outer surface including first and second diametrically opposed sides, said projecting end including a peak between divergently sloping first and second surfaces, the outer tube having a plurality of vertically aligned, spaced apart openings for receiving said plunger, each of said spaced apart openings having a supporting edge adjacent said first side of said outer surface and a plunger-deflecting edge adjacent said second side of said outer surface, said first side of said outer surface intersecting said sloping first surface at least as far out from said inner tube as said supporting edge, said second side of said outer surface intersecting said sloping second surface inward from said plunger-deflecting edge, whereby said tubes may be telescopically extended by exerting an upward force against said first tube thereby engaging said plunger-deflecting edge with said sloping second surface and depressing said plunger until it positions itself within the desired opening in said outer tube, and whereby said tubes may be retracted by manually depressing said plunger and allowing said first tube to fall until said plunger positions within the desired opening in said outer tube.

2. A store display fixture, as defined in claim 1, wherein said inner and outer tubes are rectangular in cross section.

3. A store display fixture, as defined in claim 1, said outer surface being cylindrical, said first and second sides being diametrically opposed tangents to said outer surface.

4. A store display fixture, as defined in claim 3, said openings being rectangular.

5. A store display fixture, as defined in claim 1, said first surface sloping at an angle of about 65° from the axis of said plunger and said second surface sloping at an angle of about 45° from the axis of said plunger.

6. A store display fixture, as defined in claim 1, said peak being truncated.

7. A store display fixture, as defined in claim 1, said first tube being said inner tube, and said second tube being said outer tube.

8. A store display fixture, as defined in claim 7, having three arcuate hangrods, each hangrod being affixed to a downwardly extending inner tube at each end, three outer tubes having two adjacent columns of vertically aligned and spaced apart openings along one side, each outer tube being in telescopic engagement along said adjacent columns of openings with two adjacent inner tubes from different hangrods, whereby the height of each of said hangrods is individually adjustable.

9. A store display fixture for hanging garments and the like having at least one hangrod affixed to at least one downwardly extending, inner rectangular tube in telescopic engagement with an outer rectangular tube, said outer tube extending below said inner tube, means associated with said outer tube for maintaining it in substantially vertical orientation, said inner tube including a hole through one side and a compression spring and plunger said plunger being fixed to said spring and said plunger and spring being positioned within said inner tube such that said plunger is aligned with said hole and projects therethrough, said plunger including an outer cylindrical surface and a projecting end, said outer surface having an uppermost tangent and a lowermost tangent, said projecting end including a peak between divergently sloping upward and downward surfaces, said outer tube having a least one column of vertically aligned and spaced apart openings along one side for receiving said plunger, said lowermost tangent intersecting said downward surface at least as far out from said inner tube as said openings, said uppermost tangent intersecting said upward surface inward from said openings, whereby said tubes may be telescopically extended by exerting an upward force against said inner tube, thereby automatically depressing said plunger until it positions within the desired upper opening in said outer tube, and whereby said tubes may be retracted by manually depressing said plunger and allowing said inner tube to fall until said plunger positions within the desired lower opening in said outer tube.

10. A store display fixture for hanging garments and the like having at least two hangrods secured at each end to a vertically disposed first tube in telescopic engagement with a second tube, means associated with said second tube for maintaining said tubes in substantially vertical orientation, the inner of said telescopically engaged tubes defining an opening through one side and including a spring and plunger, said plunger being secured to said spring and said plunger and said spring being positioned within said inner tube such that said plunger is aligned with and projects through said opening, said plunger including an outer surface parallel to its major axis and a projecting end, said outer surface including first and second diametrically opposed sides, said projecting end including a peak between divergently sloping first and second surfaces, the outer of said telescopically engaged tubes having a plurality of vertically aligned, spaced-apart openings having a supporting edge adjacent said first side of said outer surface and a plunger-deflecting edge adjacent said second side of said outer surface, said first side of said outer surface intersecting said sloping first surface at least as far out from said inner tube as said supporting edge, said second side of said outer surface intersecting said sloping second surface inward from said plunger-deflecting edge.

11. The store display fixture of claim 10, wherein said hangrods are arcuately curved and said second tubes associated with the ends of adjacent said hangrods are assembled in unitary columns.

* * * * *

UNITED STATES PATENT AND TRADEMARK OFFICE

CERTIFICATE OF CORRECTION

PATENT NO. : 4,181,230

DATED : January 1, 1980

INVENTOR(S) : David W. Acuff

It is certified that error appears in the above-identified patent and that said Letters Patent are hereby corrected as shown below:

Column 5, line 7, after "openings" insert -- for receiving said plunger, each of said spaced-apart openings -- .

Signed and Sealed this

*Twenty-second* Day of *April 1980*

[SEAL]

*Attest:*

SIDNEY A. DIAMOND

*Attesting Officer*

*Commissioner of Patents and Trademarks*